United States Patent [19]

Hesse et al.

[11] 4,047,903

[45] Sept. 13, 1977

[54] PROCESS FOR THE PRODUCTION OF ABRASIVES

[75] Inventors: Wolfgang Hesse, Wiesbaden; Jurgen Ritz, Mainz-Mombach; Eckart Teschner, Wiesbaden, all of Germany

[73] Assignee: Hoechst Aktiengesellschaft, Germany

[21] Appl. No.: 610,679

[22] Filed: Sept. 5, 1975

Related U.S. Application Data

[63] Continuation of Ser. No. 399,683, July 24, 1973, abandoned.

[30] Foreign Application Priority Data

Sept. 26, 1972 Germany ..... 2247103

[51] Int. Cl.[2] ..... B05D 3/06

[52] U.S. Cl. ..... 51/298 R; 51/295; 427/26; 427/44; 428/413

[58] Field of Search ..... 427/44, 25, 26, 203; 260/856; 428/413; 51/297, 298, 295

[56] References Cited

U.S. PATENT DOCUMENTS

| | | | |
|---|---|---|---|
| 3,020,255 | 2/1962 | Magrane et al. | 260/856 |
| 3,455,801 | 7/1969 | D'Alecio | 427/44 |
| 3,600,290 | 8/1971 | Fitko | 427/44 |
| 3,759,942 | 9/1973 | Himics | 427/44 |
| 3,787,273 | 1/1974 | Okrepkie et al. | 428/56 |
| 3,817,850 | 6/1974 | Feinberg | 427/44 |

FOREIGN PATENT DOCUMENTS 1,007,588 10/1965 United Kingdom

OTHER PUBLICATIONS

Giacobbe "Macromolecules" vol. 4 No. 5 Sept.-Oct. 1971 pp. 630-632.

*Primary Examiner*—John H. Newsome
*Attorney, Agent, or Firm*—Littlepage, Quaintance, Murphy, Richardson & Webner

[57] ABSTRACT

A process for preparing abrasives which comprises coating a fibrous substrate with a binder comprising a hardenable resin and subsequently curing the binder coat by electron irradiation. The radiation dose may have an energy of from 175,000 to 1,000,000 eV and a dose of from 0.5 to 30 Mrad. An abrasive which is obtained by the process and which is water resistant.

3 Claims, No Drawings

PROCESS FOR THE PRODUCTION OF ABRASIVES

This is a continuation of application Ser. No. 399,683, filed Sept. 24, 1973, which is now abandoned.

The invention is concerned with a process for the production of abrasives, in particular of water proof papers, effected by coating a substrate of fibre material with a binder based on a hardening synthetic resin and by subsequent curing with energetic radiation.

It is known to produce abrasive papers by applying a basic binder and abrasive grains to a substate which is cured yielding sufficient strength for the following applications, subsequently the sizer is applied and the product completely cured. Suitable binders are for example glutelin glue, phenolic resins and, if water proof papers are desired, polyurethane resins, epoxy resins and alkyd resins, possibly in combination with melamine resins. Special requirements as related to technique, apparatus and time are necessary for the curing process. To avoid destruction of the substrates usually consisting of cellulose curing should be effected at a maximum temperature of 120° to 130° C. Rapid curing allowing for the use of an horizontal dryer is also impossible, because of the formation of gas bubbles affecting the adhesion of the resin on the substrate. Curing of the coated material generally requires one or several hours and is therefore carried out in a loop dryer. The loop dryers through which the coated, mostly band-shaped material is passing, enable a long curing process, but there are also disadvantages, such as the formation of defects where the material is suspended, sagging of the binder and changing of the grain position due to the vertical suspension, variation of temperature and the resulting irregular crosslinking of the binder produced by the necessary slow air circulation.

It is also known to produce abrasives by coating a substrate using a photopolymerizable or -curable synthetic resin as well as abrasive grains and by subsequently curing the applied layer by means of infrared radiation. The relatively long curing period of the synthetic resin is a disadvantage of this processing method. Owing to the long curing period and the elevated temperature the substrate is also strongly attacked. Furthermore the processing speed is low during the production of abrasives.

It has been found that these disadvantages are eliminated, a considerable increase in processing speed and a greatly reduced curing time — as compared to the known methods — are achieved and nevertheless high quality, waterproof abrasives, at least equal to the abrasives so far produced — are obtained, if, according to the invention, the applied binder coat based on the hardening synthetic resin is cured by electron beams.

The binder can be applied in one or more successive layers. It is possible to prepare these coats in the same or different manner, e.g. on the basis of the same or different resins. In the case of several coats curing of the individual layers may be carried out separately.

The production of abrasives by means of energetic radiation curing is effected in accordance with the conventional system, i.e. in several operations. Applications of the base coat, grain and top coat remains substantially unchanged as compared to the method so far used. Instead of drying in the loop dryer with subsequent curing, the crosslinking is effected according to the invention by means of energetic radiation, the coated material being moved in any way, especially in horizontal order. Since curing of the binders is carried out in the horizontal position of the coated substrate the abrasive grains applied electrostatically are unable to tilt over as is the case with the known methods, so that their upright position and consequently the good abrasive effect is maintained. For the same reason sagging of the uncured binder coats is impossible. Consequently a constant coat thickness, also in case of several successive layers, is ensured in respect of the product obtained according to the invention.

Suitable synthetic resins are for example unsaturated polyesters produced from dicarboxylic acids or their functional derivatives, such as phthalic acid, isophthalic acid, terephthalic acid, trimellitic acid anhydride, fumaric acid, maleic acid, itaconic acid, succinic acid, adipic acid, suberic acid, trimethyladipic acid, azelaic acid, sebacic acid, hydrogenated phthalic acids, such as the tetra- or hexa-hydrogenated products, chlorinated acids, such as tetrachlorophthalic acid or tetrachlorosuccinic acid, in particular the dicarboxylic acids and polyhydric alcohols, e.g. ethylene glycol, dihydroxpropane, butanediol-1,3, 2,2-dimethylpropanediol-1,3, glycerine, 1, 1,1-trimethylolpropane, pentaerythrite or the like or mixtures of these polyesters with vinylmonomers. Such unsaturated polyesters additionally produced from substances comprising halogens, e.g. hexachlorendomethylenetetrahydrophthalic acid or dibromosuccinic acid, are most favourable. Furthermore suitable resins are those prepared by at least partial reaction of a) epoxy resins wtih at least 2 epoxy groups, e.g. from diphenylolpropane and epichlorohydrin with b) unsaturated monocarboxylic acids and optionally polycarboxylic acid anhydride and wherein one polycarboxlic acid anhydride molecule is added to at least 2 molecules of epoxy resin. Hereby the unsaturated polyesters are used with unsaturated monomers preferably serving as solvents. The proportion of polycarboxylic acid anhydride used is variable and depends on the proportion of monocaboxylic acid and the number of epoxy groups. The three components are generally used in such proportions that the number of epoxy groups is equal to the sum of the number of carboxylic groups of the monocarboxylic acid and the number of anhydride groups plus any free carboxyl groups of the polycarboxylic acid anhydride. For example, one epoxy resin with at least 2 epoxy groups may first be esterified with less than 2 moles of an olefinically unsaturated monocarboxylic acid - calculated on the epoxy groups - and the remaining free epoxy groups may then be partly or completely esterified with polycarboxylic acid anhydride.

For the production of the so-called binders polyfunctional epoxy resins, e.g. those produced from novolaks, diphenylolpropnae or diphenylolmethane and epichlorohydrin are suitable. Bisglycidylethers produced from diphenylolpropane or diphenylolmethane are preferred. Condensation products of aroxychlorohydrins and formaldehyde from which hydrochloric acid is split off, are suitable too.

Unsaturated monocarboxylic acids, e.g. methacrylic acid, crotonic acid and preferably acrylic acid are suitable for reaction with the epoxy resins. Examples of suitable polycarboxylic acid anhydrides for the reaction with the unsaturated partly esterified epoxy resin, in particular the reaction with monoesters of bifunctional epoxy resins, are trimellitic-, pyromellitic-, phthalic-, maleic-, and succinic anhydride.

As binders it is also possible to use such synthetic resins comprising vinyl groups as ether formation. For example polymethylolmelamine or polymethylolurea, which methylol groups are etherified or esterified with hydroxyalkylesters of unsaturated acids, such as acrylic acid, methacrylic acid or the like, can also be employed. Optionally corresponding modified resins are also applicable. Favourable results are obtained with epoxy resins comprising aceto acetic ester groups and/or chelate groups which were prepared by reaction with epoxy resins comprising hydroxy groups with diketenes to form aceto acetic ester derivatives and optionally by subsequent complex formation with metal alcoholates (of patent application Nos. P 21 38 116.8 and P 21 64 489.3 and the Belgian Pat. No. 115 632).

Suitable copolymerizable monomers are mainly vinyl combinations, such as mono- or polyfunctional esters of acrylic acid or methacrylic acid, e.g. the methyl-, ethyl-, propyl-, butyl-, hexylesters or hydroxyalkylesters of these acids, e.g. hydroxyethylacrylate, ethyleneglycoldimethacrylate. Due to the extremely high curing speed of the resins it is possible to use other monomers, such as styrene or its derivatives, such as the different kinds of vinyltoluene, γ-methylstyrene and γ-chlorostyrene, divinylbenzene, allylester of phthalic acid or the like, either alone of in mixtures. When radiation curing is effected a copolymerization of the unsaturated esterified epoxy resins is attained at the same time.

Furthermore suitable compounds comprising no polymerizable groups can be present in the form of solvents, thinners or diluents; alcohols, ketones and ether, e.g. those mentioned below, are specially suited.

The hardenable synthetic resin can be applied to the substrate with advantage in solution, preferably in solution of a copolymerizable unsaturated monomer. Otherwise it is also possible to apply the binder in form of solution comprising proportions of nonpolymerizable substances, preferably nonpolymerizable solvents. If desired further thinners can still be present. Nonpolymerizable solvents are alcohols, such as alkanols having 1 to 6 C-atoms, e.g. methanol, ethanol, propanol, butanol or the like; ketones, such as acetone, methylethylketone, cyclohexanone and ethers, such as di-isopropylether, anisole or the like.

As to energetic radiation the binder coats are mainly cured by means of electron radiation having an energy of 175,000 to 1,000,000 preferably 200,000 to 600,000 volt. The dose of radiation depends on the properties of the resin which is used as binder. The present electron radiation sources ensure a sufficient processing speed, curing require a dose of radiation of 0.5 to 30, preferably 1.0 to 12 Mrads. The processing speeds, i.e. the rate of feed of the coated material simultaneously cured, range from 10 to 120 m/min. The rates of curing and feed are variable according to width and length of the surface exposed to radiation. The dose of radiation can be varied according to the coating to be cured. Generally curing of the base coat and the top coat is carried out separately, whereby a lower dose of radiation is applied for the base coat than for the top coat. For curing the base coat the appropriate dose of radiation is for example 0.5 to 5 Mrads. Variation of the doses or radiation however is possible, the preceding values may be lower or higher.

Suitable substrates are fibrous substances, e.g. textiles, such as fabrics, textures, fleeces and cellulose comprising materials, such as paper, card-board, vulcanized fiber, but preferably paper.

The properties of abrasives based on esterified epoxy resin according to the invention correspond to those of alkyd resin abrasives. These are used for certain applications for which those based on phenolics and glutelin are unsuitable. As a result of the water resistance of alkyd resin abrasives and those according to the invention a high grinding speed with a low thermal load obtained by usual methods e.g. water cooling, is possible.

In the following examples parts represent parts by weight and % as % by weight.

EXAMPLES

1a. Production of the binder 400 parts of an epoxy resin of dimethylolpropane and epichlorophydrin with an epoxy number of 8.2 combined with 120 parts of acrylic acid, 0.66 parts of hydroquinone and 1.35 parts of N,N-dimethylaniline are heated up to 100° C until after 7 hours the acid number of 0.4 is obtained. At that stage 133 parts of ethylacrylate are added to form a solution of an unsaturated epoxy ester with a viscosity of 800 cP/20° C.

At room temperature 4 parts of dimethylaniline are added to this solution while stirring for 1 hour. Thereafter 31 parts of diketene are slowly added to the solution whhle stirring at 50° C. The temperature shall not exceed 60° C. After addition of diketene the batch is maintained at 50° C for further 30 minutes and subsequently cooled down to room temperature. The solution thus obtained has a solids content of 81.3% and a viscosity of 1200 cP/Lb 20° C.

100 parts of this solution comprising an epoxy resin esterified with acrylic acid and modified with aceto acetic ester groups are combined with 8.8 parts of a 50% solution of aluminium-triisopropylate and anhydrous toluene while stirring for 15 minutes at room temperature. After 2 hours rest the solution has a viscosity of 1300 cP at 20° C which remains practically unchanged during the following 24 hours. An aluminium chelate complex of the modified epoxy resin has been formed.

b. Production of the abrasive paper

A latex impregnated paper, normally used in the abrasives industry, of 120 g/m² is used as substrate. The above mentioned binder is applied to the latex coated paper at a wet coat thickness of 50 μ by means of a film application apparatus. Silicon carbide (grain FEPA No. 80) is sprinkled excessively on the wet binder film and the excess is removed. Subsequently the basic binder is cured with a radiation dose of 1.5 Mrad. The electron radiation source employed for curing is operated by an accelerating voltage of 400 kilovolt and an acceleration current of 60 mA. Operating speed: 47 m/min. 120 g/m² of the same binder is applied as top coat to the semi-product by means of rubber rollers. The material is then cured with a dose of radiation of 3.0 Mrad. at a processing speed of 23.5 m/nim.

Tests

The thus obtained abrasive paper samples are cut into round disks at an external diameter of 178 mm and an internal diameter of 22 mm and fastened on vulcanized fiber disks of the same size, thickness 0.8 mm, with contact adhesives. These test samples are attached to a conventional grinding machine with rubber plates which operates at 1200 r/min. By means of a fixing device a flat-bar steel of 20 × 4 mm is radially moved inwards from the periphery of the disk in tangential order of 5 mm and pressed with a frictional contact angle of 25° in axial direction with an absolute force of 4 bar, the angle of attack being in the sense of rotation. During the whole grinding process of 10 minutes water of about 16° C is poured over the point of attack.

After a grinding time of 10 minutes the abrasive coat is completely attrited. 11.1 g were cut of from the test steel.

2a. Production of the binder 1900 parts of the epoxy resin mentioned in example 1 are esterified with 540 parts of acrylic acid in the presence of 0.62 parts of hydroquinone and 8.25 parts of N,N-dimethylaniline at 90° C until the acid number is about 20 and the epoxy number 1.8. 370 parts of phthalic acid anhydride are then added and the reaction is continued at 90° C until the acid number is again about 20 and the epoxy number about 0.2 to 0.4. At that stage, the reaction mixture is dissolved in 712 parts of ethylacrylate to form at 80% solution. The viscosity is 14,000 to 20,000 cP/20° C.

b. Production of a waterproof abrasive paper 1000 parts of this resin are mixed with 100 parts of butanol at room temperature, whereby the viscosity is reduced to 1400 cP/20° C. The production of waterproof abrasive paper is carried out according to example 1, but the base coat is cured with 1.0 Mrad. and the top coat with 0.4 Mrad.

Tests of the waterproof abrasive paper

The tests are carried out according to example 2. The amount of steel cut off accounts for 12.0 g.

3a. Production of the binder 100 parts of hexakismethoxymethylmelamine, 350 parts of hydroxyethylacrylate and 0.9 parts of hydroquinone are heated in the presence of carbon dioxide at a distillation apparatus up to 115° C for 2 hours, the reaction is continued at 115° C for 3 hours 45.3 parts of a distillate are produced mainly comprising methanol. The synethetic resin solution obtained with a yield of 390 g has a viscosity of 300 cP/20° C.

b. Production of a waterproof abrasive paper

The synthetic resin solution of Example 3a is used as described in Example 1 for the production of abrasive paper. For curing the basic layer a dose of radiation of 0.2 Mrad. is employed and for the top coat a dose of 5.0 Mrad.

Tests of the abrasive paper

Tests are carried out as shown in example 1, the amount of steel cuttings has a weight of 10.1 g.

Comparative tests

4. For comparative tests abrasive paper is produced with conventional binders and by means of conventional curing.

The same materials as described in example 1 serve as substrate and grain. The basic binder consists of an oxidative drying short oil alkyd resin, modified with castor oil and soya oil, produced from pentaerythrite, phthalic acid anhydride and trimethylolpropane, (acid number below 40, viscosity in 50% xylene at 20° C, 650 to 800 cP), available as a 60% solution in xylene and comprising 42% oil as triglyceride and 36% phthalic acid anhydride calculated on 100% dry substance. The resin is dried with 0.03% lead and 0.01 mangenese, both in the form of octoates, calculated on the weight of 100% resin. The basic binder is applied to the latex coated paper by means of a film application apparatus at a wet film thickness of 70 μ. Subsequently — as described in example 1 — silicon carbide is sprinkled and the basic binder is cured for 1 hour at 120° C. As described in example 1, 200 g/m² of a sizer is applied to the semi-product comprising 70 parts of the same alkyd resin, as used in the form of basic binder — and 30 parts of nonplasticizing, high reactive melamine resin, partially etherified with butanol (mole ratio melamine : formaldehyde 1:6) dissolved in butanol (1:1). Curing is effected so that the coating is initially dried for 20 minutes at 80° C and then cured for 40 minutes at 130° C.

Tests

Tests are carried out as described in example 1. The amount of steel cuttings account for 10.3 g.

5. This comparative test is carried out according to the test (4) using a drying long oil alkyd resin, plasticized with linseed oil with a viscosity of 290 cP/20° C in 50% white spirit solution, which comprises 65% oil as triglyceride and 24% phthalic acid anhydride calculated on 100% dry substance as basic binder and sizer. The basic binder is dried with 0.03% load and 0.01% manganese, and the sizer is dried with 0.03% lead, 0.01% manganese and 0.03% cobalt, all three metals as octoate.

Curing of the basic binder is effected at 120° C for 2 hour, the sizer is cured for 4 hours at 130° C.

Tests

The test is carried out as described in example 1. The amount of steel cuttings accounts for 7.7 g.

What we claim is:

1. A process for preparing a waterproof abrasive which comprises forming a waterproof abrasive by coating a fibrous substrate with a plurality of successive layers including at least one base layer of a binder resin hardenable by irradiation, at least one intermediate layer of abrasive grains and at least one top layer of binding resin hardenable by irradiation and thereafter curing the resin layers by electron irradiation; at least one of said resin layers being selected from the group consisting of A. the reaction product of a polycarboxylic acid (A1) with an esterified epoxy resin (A2), prepared by reaction of an epoxy resin with a member selected from the goup consisting of
   a. acrylic acid,
   b. methacrylic acid,
   c. a mixture of (a) and (b) and
B. the reaction product of (A2) first reacted with diketenes and then reacted with a chelate forming compound.

2. A water resistant abrasive consisting of a fibrous substrate

A. having coated thereon successive layers as follows:
   a. at least one base layer of a binder comprising a resin hardenable by radiation,
   b. at least one intermediate layer of abrasive grains and
   c. at least one top layer of a binder comprising a resin hardenable by radiation B. at least one of said resin layers being selected from the group consisting of C. the reaction product of a polycarboxylic acid (C1) with an esterified epoxy resin (C2) prepared by reaction of an epoxy resin with a member selected from the group consisting of d. acrylic acid, e. methacrylic acid, f. a mixture of (d) and (e) and D. the reaction product of (C2) first reacted with diketenes and then reacted with a chelate forming compound.

3. The water resistant abrasive of claim 2 wherein the resin binder is hardened by electron irradiation at an energy level of from 175,000 to 1,000,000 eV and at a dosage rate of from 0.5 to 30 Mrad.

* * * * *